US007473831B2

(12) United States Patent
Cody

(10) Patent No.: US 7,473,831 B2
(45) Date of Patent: Jan. 6, 2009

(54) GUITAR WITH DUAL SOUND BOARDS

(76) Inventor: William F. Cody, 1115 21st St., Tell City, IN (US)

( * ) Notice: Subject to any disclaimer, the term of this patent is extended or adjusted under 35 U.S.C. 154(b) by 133 days.

(21) Appl. No.: 11/728,806

(22) Filed: Mar. 27, 2007

(65) Prior Publication Data

US 2007/0234872 A1 Oct. 11, 2007

Related U.S. Application Data

(60) Provisional application No. 60/789,973, filed on Apr. 6, 2006.

(51) Int. Cl.
*G10D 13/02* (2006.01)

(52) U.S. Cl. ..... 84/291

(58) Field of Classification Search ..... 84/267, 84/290, 291, 294, 298
See application file for complete search history.

(56) References Cited

U.S. PATENT DOCUMENTS 6,459,024 B1 * 10/2002 Baker ..... 84/291
7,151,210 B2 * 12/2006 Janes et al. ..... 84/291
7,288,706 B2 * 10/2007 Gaffga ..... 84/291

* cited by examiner

*Primary Examiner*—Kimberly R Lockett
(74) *Attorney, Agent, or Firm*—Gary K. Price

(57) ABSTRACT

A stringed musical instrument having a back, a side and a first sound board that form a sound box. The back, side and first sound board further define an enclosed resonant cavity within the sound box. A bridge is positioned on the surface of the first sound board on a side of the hole opposite a neck for attaching strings. A second sound board is positioned in opposition in a spaced relation to the first sound board within the cavity of the sound box, sandwiched in spaced relation between the back and the first sound board. The first and second sound boards each having a hole formed therein. The bridge further includes a sound transfer bar vertically disposed between the first sound board and the second sound board. The sound transfer bar effectively transfers vibrations from the first sound board to the second sound board and further equalizes any upward or downward pull by the bridge caused by the tension of the strings.

16 Claims, 6 Drawing Sheets

GUITAR WITH DUAL SOUND BOARDS

CROSS REFERENCES TO RELATED APPLICATIONS

U.S. Provisional Application for Patent No. 60/789,973, filed Apr. 6, 2006, with title "Guitar with Dual Sound Boards" which is hereby incorporated by reference. Applicant claims priority pursuant to 35 U.S.C. par. 119(e)(i).

STATEMENT AS TO RIGHTS TO INVENTIONS MADE UNDER FEDERALLY SPONSORED RESEARCH AND DEVELOPMENT

Not applicable.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a sound board system for a stringed musical instrument and to stringed musical instruments having such a sound board system. This invention has particular application where the stringed musical instrument is a guitar, though the invention has application to any stringed musical instrument.

2. Brief Description of Prior Art

A stringed musical instrument typically has multiple strings strung at high tension from a neck to a bridge. Such an instrument has a single sound board, typically, with at least one sound hole. The stringed musical instrument further includes a back and a side that extends between the perimeter of the sound board and the perimeter of the back and maintains the sound board and the back in spaced relation. The sound board, the back and the side cooperate to define a sound box and further define a resonating chamber within the sound box. The sound hole disposed in the sound board enables sound waves to emerge from the sound box.

The stringed instrument further includes a neck and a bridge secured to the sound box in a manner known in the art. The neck includes a head positioned at an end thereof opposite the sound box. In a guitar, the sound hole in the sound board is typically disposed between the neck and the bridge and strings are secured between the head and the bridge and over the hole in the sound board in a manner known in the art.

It is always desirable to achieve greater sound volume from a stringed musical instrument. It is also desirable to achieve better tone quality from a stringed musical instrument, such as by producing sound that has a more complex texture or a richer base. As will be seen from the subsequent description, the preferred embodiments of the present invention achieve these objectives and overcome disadvantages of the prior art.

SUMMARY OF THE INVENTION

In accordance with the present invention, a stringed musical instrument with dual sound boards is provided. The stringed musical instrument of the present invention includes a back, a side and a first sound board that form a sound box. The first sound board has a first hole formed therein. The back, side and first sound board further define an enclosed resonant cavity within the sound box. A bridge is positioned on the first sound board on a side of the hole opposite a neck. A second sound board is positioned within the cavity of the sound box, sandwiched in spaced relation between the back and the first sound board. The second sound board has a second hole formed therein. The bridge further includes a sound transfer bar vertically disposed between the first sound board and the second sound board. The sound transfer bar effectively transmits vibrations between the first sound board and the second sound board and further equalizes any upward or downward pull by the bridge caused by the tension of the strings.

DESCRIPTION OF THE PREFERRED EMBODIMENT

Figure 1:
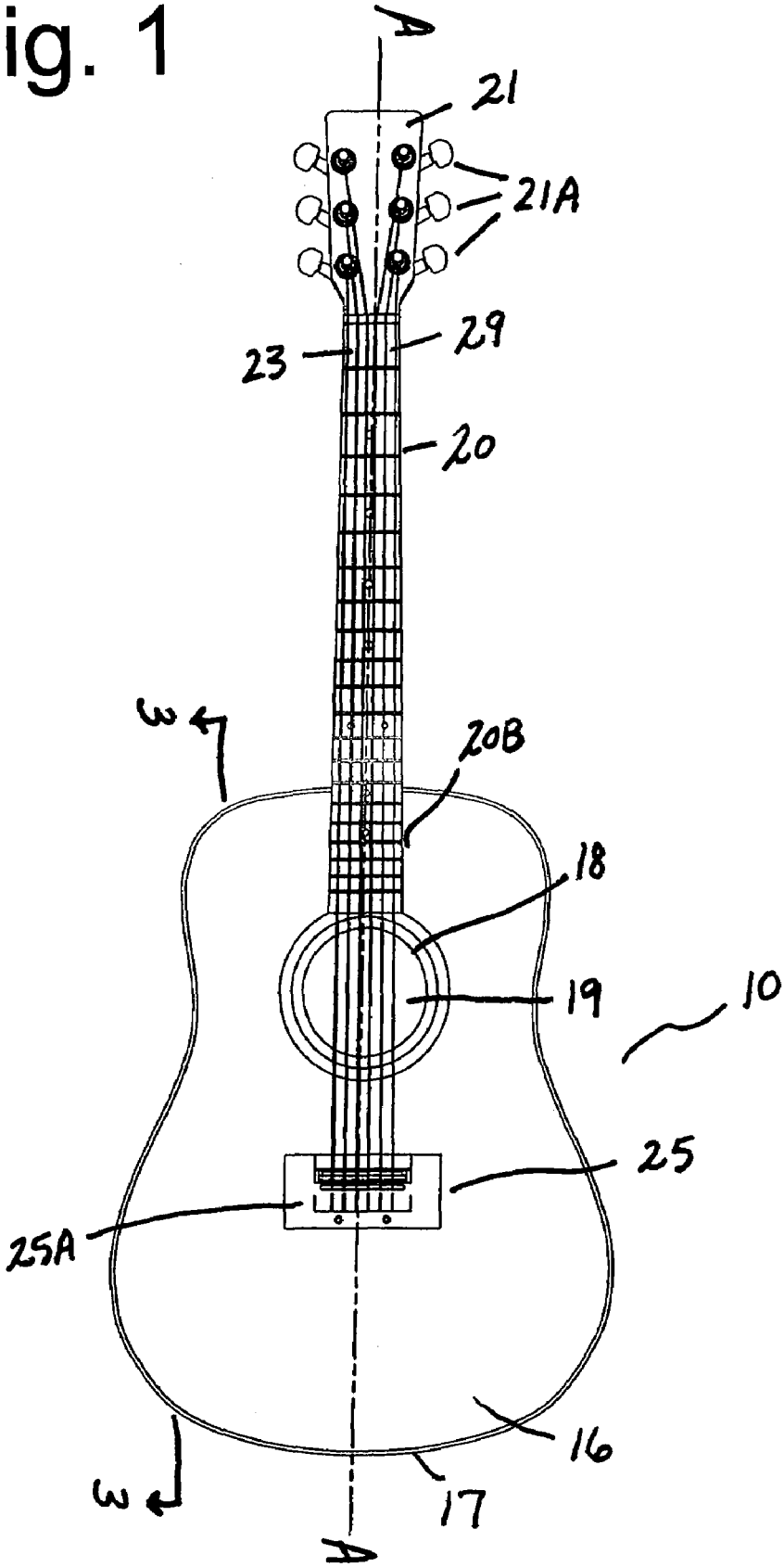
FIG. 1 is a top plan view of an acoustic guitar constructed in accordance with the preferred embodiment of the invention.

In accordance with the present invention, a guitar with dual sound boards is disclosed. The guitar is directed to a unique instrument design having dual sound boards that increase the sound volume and produces a richer sound that has a more complex texture. Specifically, it will be noted in the drawings that the stringed instrument of the present invention includes a first or outer sound board, a second or inner sound board, and a bridge that extends between the two sound boards. The two sound boards of this design tend to equalize any upward or downward pull by the bridge caused by the tension of the strings. In the broadest context, the stringed instrument of the present invention consists of components configured and correlated with respect to each other so as to attain the desired objective.

FIGS. 1-6 illustrate a preferred embodiment of a stringed musical instrument of the present invention. In one embodiment, the stringed musical instrument is an acoustic guitar 10. Although the invention is discussed in conjunction with an embodiment where the stringed musical instrument is an acoustic guitar, after reading the description it will be apparent to those skilled in the art that the invention may be applied to other stringed instruments.

As illustrated in the drawings, the guitar 10 has a back 12 and a side 14, the side 14 having a top portion 14A and a bottom portion 14B. The back 12 is attached to the bottom portion 14B of the side 14. A first or outer sound board 16 is attached to the top portion 14A of the side 14. The back 12, side 14 and first sound board 16 form a sound box 17. The sound board 16 has a hole 18 formed therein for the passage of sound therethrough. The back 12, side 14 and first sound board 16 further define an enclosed resonant cavity 19 within the sound box 17.

A neck 20 having a head 21 at an end the sound box 17 is attached to the sound box 17 and extends therefrom in a manner known in the art. In particular, the neck 20 has an upper end 20A and a lower end 20B. The lower end 20B of the neck 20 is attached to and extends from a low portion 14C of the side 14 in a conventional manner. The head 21 is connected to the upper end 20A of the neck 20. A finger board 23 is mounted on the neck 20. The finger board 23 may extend beyond the lower end 20B of the neck 20, to the first sound board 16.

As illustrated, strings 29 are strung between tuning mechanisms 21A of the head 21 and the bridge 25. In particular, the strings 29 extend from the tuning mechanisms 21A and pass over the neck 20, over the first sound board 16, and attach to the bridge 25 in a conventional manner.

The bridge 25 is positioned on the first sound board 16 on a side of the hole 18 opposite the neck 21. The bridge 25 and the neck 21 are aligned with a longitudinal axis A (shown in FIG. 1) of the stringed instrument 10.

Figure 3:
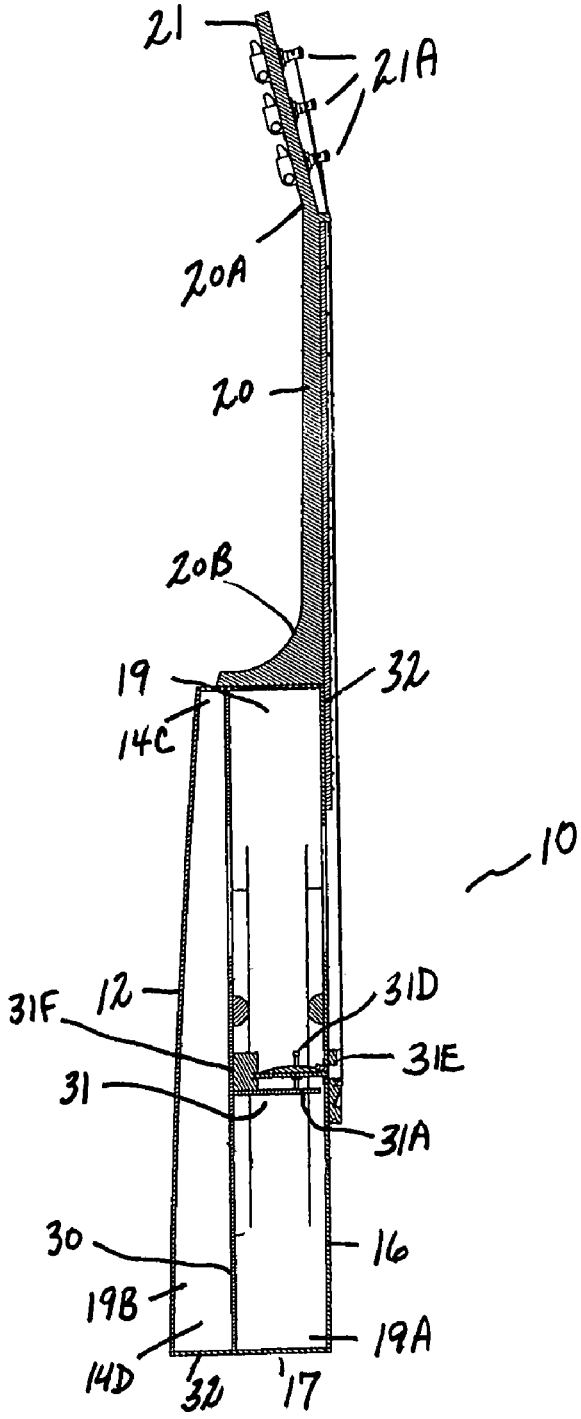
FIG. 3 is a view in cross-section along the line 3-3 of FIG. 1
Figure 4:
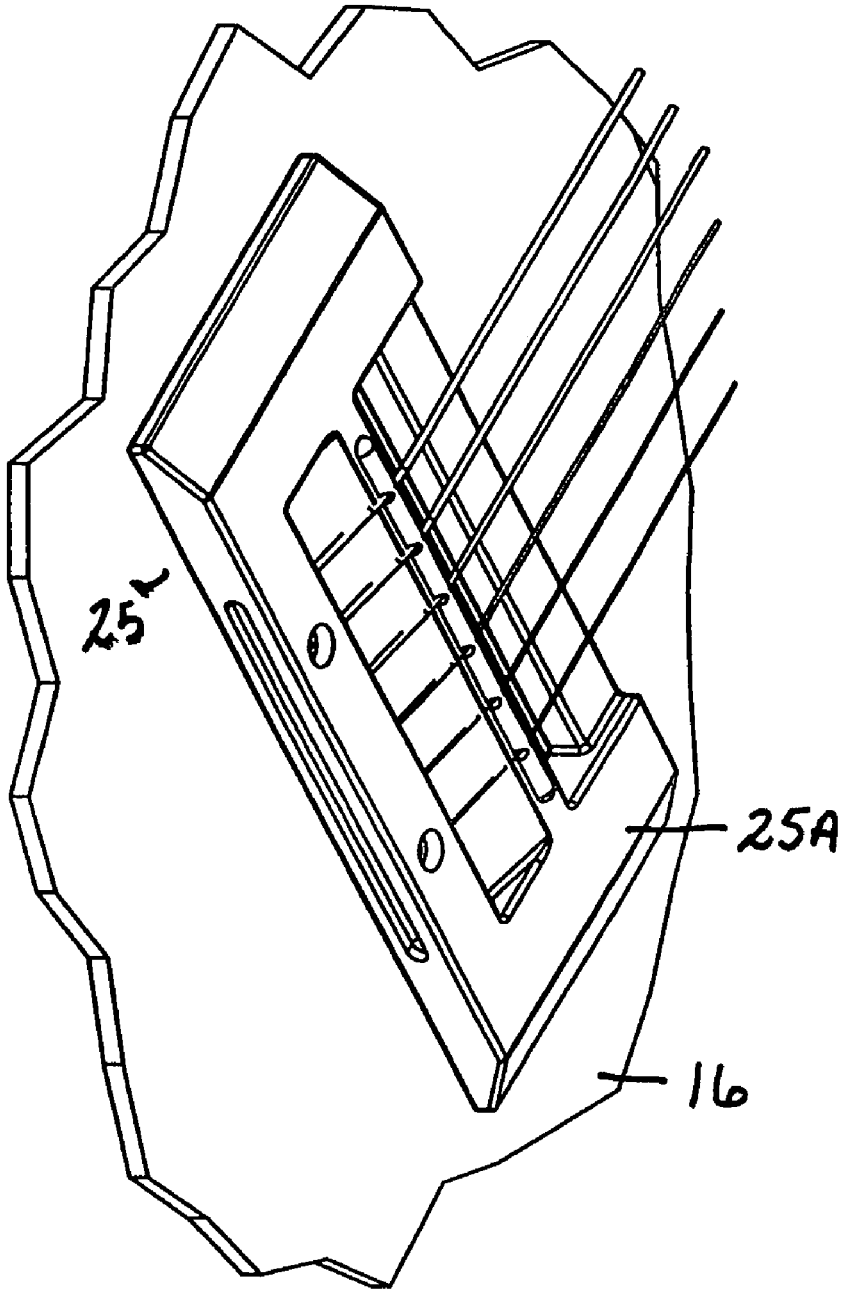
FIG. 4 is an exploded perspective view of the bridge positioned on the first sound board of the acoustic guitar.

Referring to FIG. 3, a second or inner sound board 30, having generally the same outline and size as the first sound board 16, is positioned in parallel opposition to the first sound board 16 within the cavity 19 of the sound box 17, sandwiched in spaced relation between the back 12 and the front sound board 16. This position of the second sound board 30 as described forms a first cavity section 19A and a second cavity section 19B within the resonant cavity 19 of the sound box 17. Spacers 32 are positioned in the sound box 17 preferably around the peripheral edges thereof, between the back 12 and the sound board 30 to maintain the back 12 and sound board 30 in spaced relation thereby forming the second cavity 19B, and between the second sound board 30 and the first sound board 16 to maintain the sound boards 30,16 in spaced relation thereby forming the first cavity 19B. The second sound board 30 also includes a hole 18A shown in FIG. 5.

Figure 2:
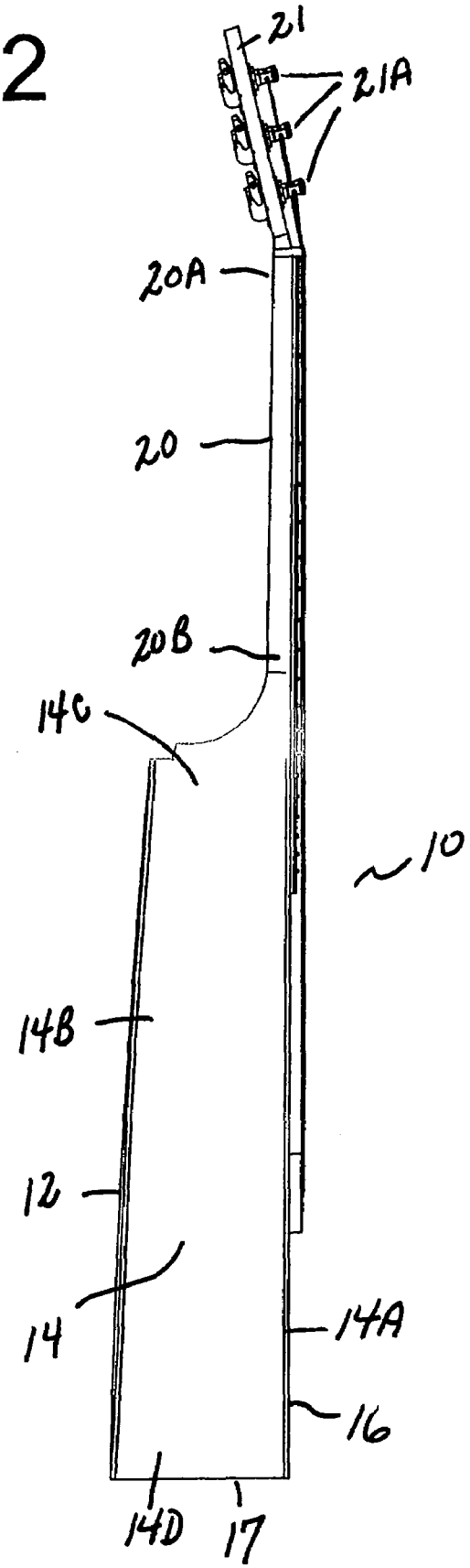
FIG. 2 is a side view of the guitar of FIG. 1.

As best shown in FIG. 2, the side 14 further includes the low portion 14C and a high portion 14D, such that the distance between the top portion 14A and the bottom portion 14B of the low portion 14C is less than the distance between the top portion 14A and the bottom portion 14B of the high portion 14D. Likewise, as shown in FIG. 3, the distance between the second sound board 30 and back 12 at the low portion 14C is less than the distance between the second sound board 30 and back portion 12 at the high portion 14D however, as shown in the drawings, the distance between the first sound board 16 and the second sound board 30 at the low portion 14C is equal to the distance between the first sound board 16 and the second sound board 30 at the high portion 14D. The distance between the back 12 and the second sound board 30 and/or the first and second sound boards 16, 30 is not to be construed as limiting the invention.

As is known, the bridge 25 represents the point where the strings 29 come into contact with the first sound board 16. In application, the bridge 25 plays a vital part in transferring to the cavity 19 of the sound box 17 the energy that creates the amplified sound. In particular, the energy created by the vibrating string 29 is passed from the bridge 25 into the sound box 17 via the bridge saddle 25A. The sound box 17 acts as an acoustic chamber vibrating with strings 29. This vibrating produces the sound, most of which emerges through the hole 18 of the first sound board 16.

In the present invention, the bridge 25 further includes a sound transfer bar 31 (shown in FIG. 3) vertically disposed between the first sound board 16 and the second sound board 30. The first cavity section 19A is interrupted only by the vertical sound transfer bar 31 positioned between the sound boards 16, 30. The bar 31 can be attached to the sound boards 16, 30. The sound transfer bar 31 effectively transfers or transmits vibrations between the first sound board 16 as discussed above to the second sound board 30 and further equalizes any upward or downward pull, force or torque by the bridge 25 caused by the tension of the strings 29. The provision of a stringed musical instrument having two resonant cavities 19A, 19B coupled together within the sound box 17, rather than the conventional single cavity, provides for a unique instrument with enhanced tonal qualities.

Figure 5:
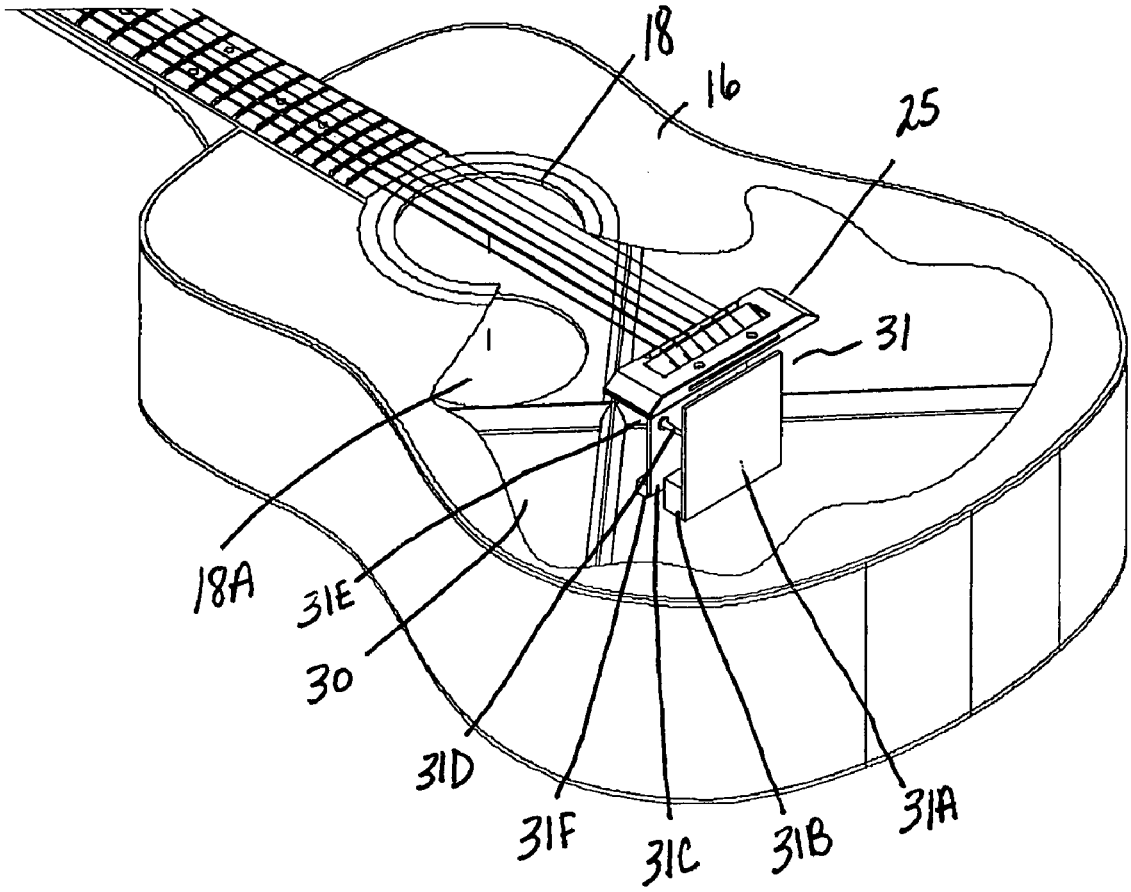
FIGS. 5 and 6 show partial cutaway views of the guitar.
Figure 6:
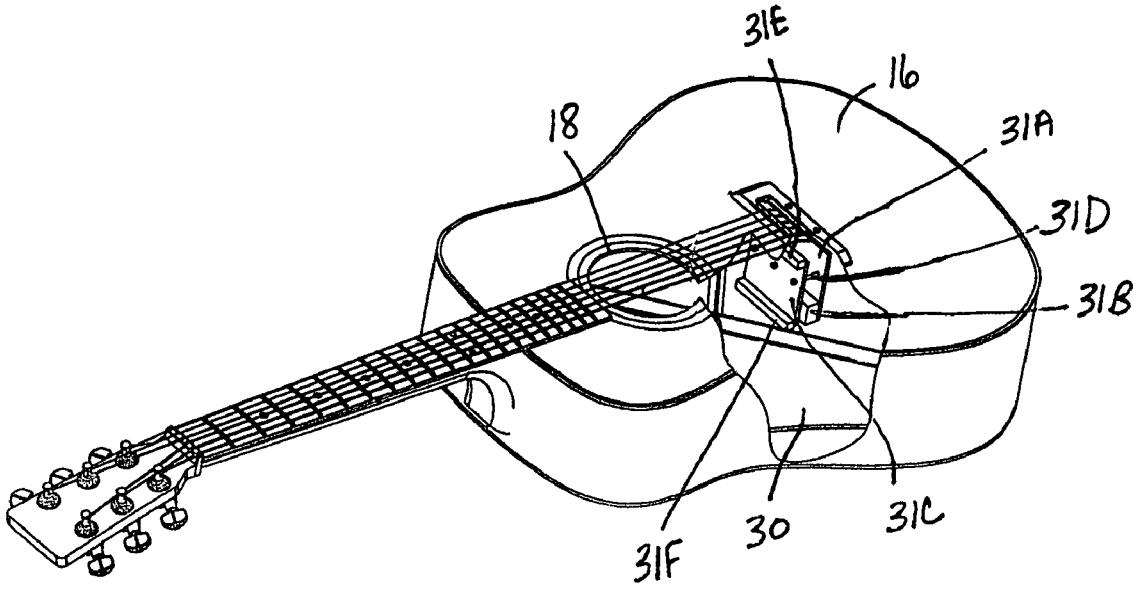

FIG. 5 shows the bridge 25 on the first sound board 16, and shows the first sound board 16 partially cutaway to reveal details of the second sound board 30 and sound transfer bar 31. The second sound board 30 is spaced from the back 12 of the guitar 10 and includes a second sound hole 18A that can be aligned with the first sound hole 18 and can be of about the same diameter such that sound from the second cavity 19B can pass through the hole 18A and on through the hole 18.

FIG. 5 shows the sound transfer bar 31 includes a first plate 31A that can be attached to a block 31B that in turn is attached to the second sound board 30 but not to the first sound board 16. The first plate 31A is separate from the first sound board 16. A second plate 31C floats between the sound boards 16 and 30. The floating plate 31C includes elongated fasteners such as at least one screws 31D threadingly attached to the plate 31C. These at least one screws 31D press against the first plate 31A to hold the floating second plate 31C against locks 31E and 31F, the tighter the screws 31D are tightened, the tighter plate 31C is pressed against blocks 31E and 31F. Block 31E is attached to the sound board 16 and block 31F is attached to the second sound board 30. This arrangement has several advantages. The sound transfer plate 31 can adjustably provide support to the upper sound board 16. Specifically, the at least one screws 31D can be tightened to tend to resist torque and force applied to the bridge 25 by tightening strings 29. This allows the sound board 16 to be made of a thinner somewhat more flexible material than would normally be possible. Sound board 30 can also be thinner than a normal sound board because it does not have a bridge and strings attached. The thinner sound board 16 will generate a louder sound. Further, the sound transfer bar 31 allows for sound to transfer through the bridge 25 to the second sound board 30 but the "floating" arrangement allows for unrestricted motion of the planar sound boards 16 and 30 in a direction perpendicular to the planes of the planar sound board 16 and 30. If the sound transfer bar 31 were simply glued or otherwise rigidly attached to the sound boards 16 and 30, it would severely restrict motion of both planar sound boards and would tend to dampen the vibration of sound through the guitar 10. As shown, each sound board 16 and 30 is virtually unrestricted by the sound transfer bar 31 leading to a rich tone quality and greater sound produced by the dual sound board. The rich tone can arise in part from slight variations and vibrations between the two sound boards 16 and 30 and sound chambers 19A and B.

Each of the above-described attachments may be accomplished using conventional means such as an adhesive (e.g., glue), though other means of attachment may also be used.

It can be seen from FIGS. 3 and 5 that the first and second sound boards 16 and 30 are approximately the same size and shape and that the first and second sound holes 18 and 18A are approximately aligned such that sound coming from the second sound hole 18A can pass through the first sound hole 18 and thereby exit the sound box.

Although the description above contains many specificities, these should not be construed as limiting the scope of the invention but as merely providing illustrations of some of the presently preferred embodiments of this invention.

It would be obvious to those skilled in the art that modifications be made to the embodiments described above without departing from the scope of the present invention. Thus the scope of the invention should be determined by the appended claims in the formal application and their legal equivalents rather than by the examples given.

I claim:

1. A stringed musical instrument comprising:

a back, a side and a first sound board that form a sound box, wherein said sound board includes a first hole formed therein and said sound box having a resonant cavity defined therein, wherein said hole is in communication with said cavity, a bridge positioned on the first sound board on a side of the hole opposite a neck, a second sound board disposed within the cavity of the sound box, said second sound board sandwiched in spaced relation between said back and the first sound board and including a second hole formed therein, said bridge including a sound transfer bar vertically disposed between the first sound board and the second sound board, said sound transfer bar designed to transfer vibrations from the first sound board to the second sound board and further designed to equalize any force caused by tension of an instrument's string on said bridge.

2. The stringed musical instrument as recited in claim 1, wherein said second sound board is parallel to said first sound board and approximately the same size and shape as said first sound board, dividing said cavity into two sub-cavities.

3. The stringed musical instrument as recited in claim 1, wherein said first hole is aligned with said second sound hole such that sound from said second sound hole can travel through said first sound hole to exit said cavity.

4. The stringed musical instrument as recited in claim 1, wherein said sound transfer bar includes two plates, a first plate is attached to said second sound board and a second plate has a first connection to said first sound board and a second connection to said second sound board wherein said first and second connections are maintained by at least one screw holding said second plate against a portion of said first and second sound boards.

5. The stringed musical instrument as recited in claim 1, wherein said sound cavity is shorter adjacent said neck portion of said instrument.

6. A guitar instrument comprising:

a back, a side and a first sound board that form a sound box, wherein said sound board includes a first hole formed therein and said sound box having a resonant cavity defined therein, wherein said hole is in communication with said resonant cavity, a bridge positioned on the first sound board on a side of the hole opposite a neck to which a first end of a plurality of strings are attached, said plurality of strings having a plurality of second ends attached to said bridge, a second sound board disposed within the cavity of the sound box, said second sound board sandwiched in spaced relation between said back and the first sound board, said bridge including a sound transfer bar vertically disposed between the first sound board and the second sound board, said sound transfer bar designed to transfer vibrations from the first sound board to the second sound board and further designed to equalize any force caused by tension of said instrument strings on said bridge.

7. The guitar instrument as recited in claim 6, wherein said second sound board includes a second sound hole.

8. The guitar instrument as recited in claim 7, wherein said second sound board is parallel to said first sound board and approximately the same size and shape as said first sound board, wherein said second sound board divides said cavity into two sub-cavities.

9. The guitar instrument as recited in claim 7, wherein said sound transfer bar includes two plates, a first plate is attached to said second sound board and a second plate has a first connection to said first sound board and a second connection to said second sound board wherein said first and second connections are maintained by at least one fastener holding said second plate against a portion of said first and a portion of said second sound boards such that sound can transfer through said second plate from said first sound board to said second sound board but said first and second sound boards can move relative to each other.

10. The guitar instrument as recited in claim 7, wherein said sound cavity is shorter adjacent said neck portion of said instrument.

11. The guitar instrument as recited in claim 7, wherein said second sound hole is aligned with said first sound hole and having a side similar to said first sound hole.

12. A stringed musical instrument having a plurality of strings connected from a neck portion to a bridge, said strings passing over a first sound hole, said instrument comprising:

a sound box, wherein said sound box includes a first planar sound board that includes said first hole formed therein and said sound box having a resonant cavity defined therein, wherein said first hole is in communication with said resonant cavity, a bridge positioned on said first sound board, a second planar sound board disposed within the cavity of the sound box, said second sound board divides said sound cavity into two sub-cavities, said bridge including a sound transfer bar disposed between the first planar sound board and the second planar sound board, said sound transfer bar designed to transfer vibrations from the first planar sound board to the second planar sound board and further designed to strengthen said first planar sound board.

13. The instrument as recited in claim 12, wherein said second planar sound board includes a second sound hole aligned with said first sound hole such that sound from said second sound hole can travel through said first sound hole to thereby exit the sound box.

14. The instrument as recited in claim 13, wherein said second planar sound board is parallel to said first planar sound board and approximately the same size and shape as said first planar sound board.

15. The instrument as recited in claim 14, wherein said sound transfer bar includes a first plate attached to said second planar sound board and a second plate having a first connection to said first planar sound board and a second connection to said second planar sound board wherein said first and second connections allow the second plate to float and are maintained by at least one fastener forcing said second plate against a portion of said first and a portion of said second planar sound boards such that sound can transfer through said second plate from said first planar sound board to said second planar sound board but said first and second planar sound boards can move relative to each other in a direction perpendicular to the planar sound boards with said second plate floating.

16. The instrument as recited in claim 15, wherein said sound cavity is shorter adjacent said neck portion of said instrument.

* * * * *